United States Patent [19]

Hepple

[11] Patent Number: 4,542,556

[45] Date of Patent: Sep. 24, 1985

[54] CARPET VACUUM, CLEANING, AND DYEING APPARATUS

[75] Inventor: Jeffry S. Hepple, Waco, Tex.

[73] Assignee: Hightec Manufacturing Corporation, Waco, Tex.

[21] Appl. No.: 577,070

[22] Filed: Feb. 6, 1984

[51] Int. Cl.[4] ..... A47L 11/34

[52] U.S. Cl. ..... 15/321; 15/322; 15/353; 15/354

[58] Field of Search ..... 15/320, 321, 322, 353, 15/354

[56] References Cited

U.S. PATENT DOCUMENTS

| | | | |
|---|---|---|---|
| 3,619,849 | 11/1971 | Jones | 15/321 |
| 3,654,662 | 4/1972 | Bates | 15/322 X |
| 3,818,537 | 6/1974 | Evans | 15/321 |
| 3,919,729 | 11/1975 | Cannan | 15/321 X |
| 3,942,215 | 3/1976 | Olds | 15/320 |
| 4,139,922 | 2/1979 | Fitch | 15/321 |
| 4,167,799 | 9/1979 | Webb | 15/322 X |
| 4,207,649 | 6/1980 | Bates | 15/321 X |
| 4,218,900 | 8/1980 | Caplan et al. | 15/322 X |
| 4,307,484 | 12/1981 | Williams | 15/321 |
| 4,360,946 | 11/1982 | Marshall et al. | 15/321 |

*Primary Examiner*—Chris K. Moore
*Attorney, Agent, or Firm*—Neal J. Mosely

[57] ABSTRACT

A combination carpet vacuum, cleaning, and dyeing apparatus comprises a powerbase unit which houses vacuum and water pressure systems, electrical circuitry, and mixing devices to supply a remote operator-controlled powerhead unit with various solutions of water and other chemicals. The powerhead unit carries a 24 volt D.C. motor and worm gear transmission which drives a pair of horizontal counter rotating brushes; a floating vacuum head; electronic circuitry; and selectable sprayer manifolds for carpet cleaning or dyeing operations. Switches in the pivotal handle of the powerhead provide the operator with manifold selection, motor control, and remote vacuum control. A clear plastic pick-up tube on the powerhead handle and a clear dome on the powerbase unit allow the extraction process to be observed. The powerhead unit is releasably connected to the powerbase unit by a vacuum hose, a pressure line, and an electrical cord. Safety sensors in the powerbase unit actuate lights on an instrument panel to warn the operator of a low water supply or a full recovery tank will shut off the water pump or the vacuum motor.

29 Claims, 8 Drawing Figures

CARPET VACUUM, CLEANING, AND DYEING APPARATUS

BACKGROUND OF THE INVENTION

1. Field of the Invention

This invention relates to carpet treating apparatus, and more particularly to a combination carpet vacuum, cleaning, and dyeing apparatus.

2. Brief Description of the Prior Art

A variety of machines have been developed for cleaning and dyeing carpets. True carpet cleaners such as the steam cleaners are dependent upon the available amperage in a typical building to generate steam. In many instances only 15 amps or less are available, which is insufficient to create steam.

Truck mounted cleaners having a gasoline or diesel power plant in a remote truck generate enormous heat, pressure, and vacuum. The truck mounted units are expensive, require great lengths of hose, and generate excessive heat which can set the carpet nap or damage the fiber.

Equipment used for dyeing carpet has included pesticide sprayers, paint guns, carpet shampooers, hand brushes, hot water extractors, or combinations thereof.

In order to perform satisfactory cleaning and dyeing operations, the carpet must first be dry vacuumed. Both operations require the introduction of liquid solution to the carpet surface, and the extraction of excess water. The cleaning operation requires high pressure at low volume while in the the dyeing operation, high pressure can cause detrimental overspray and even distribution of the liquid is paramount.

In either operation, mechanical action is required, but not well provided by the conventional methods. The scrub wand of truck mounted units and extractors depends upon the operators physical strength. Rotary scrubbers and buffers lay the carpet fiber flat thus forming a barrier to the cleaning and dyeing chemicals.

Both the cleaning and dyeing operations require the removal of excess liquids and occasionally a rinse or flushing step. The process is similar in cleaning and dyeing operations except for the spray tip location.

There are several patents which disclose various carpet cleaning and dyeing apparatus.

Olson, U.S. Pat. No. 1,198,373 discloses a process for dyeing rugs whereby a rug is supported upon a mat of metallic strips and dye is applied to its upper surface with a spray gun and then brushed with a broom to uniformly distribute the dye over the surface and force it into the nap. The dye is fixed by placing the rug in a drying chamber provided with dry steam where it remains for up to forty eight hours, then it is placed into a second chamber where wet steam is introduced to complete the fixing operation.

Longshore, et al, U.S. Pat. No. 2,149,453 discloses a vacuum scrubber machine which may be selectively operated with all of the weight on the brush, backwards and forwards and also laterally. The machine operates as a dry dust vacuum cleaner when moved laterally in one direction and then as a scrubber when moved laterally in the opposite direction, supplying its own suds, and by reversing the direction again, pick up the dirty lather and suds and deposit them in a tank carried by the machine. The vacuum mechanism may be removed from the rest of the machine to clean draperies and the like leaving the polishing machine intact for separate use.

Crener, et al, U.S. Pat. No. 3,639,939 discloses a combination floor polisher, scrubber, cleaner or sander. A shutter movable between a first position covers an opening in the air passageway of the suction cleaning component of the apparatus so that it will operate properly as a suction cleaner. In the first position, a mechanism for dispensing liquid wax from a container is rendered inoperable and a vessel for holding liquid detergent cannot be mounted on the apparatus. When the shutter is in its second position, the passageway is opened and the apparatus can not operate as a suction cleaner but the liquid wax dispenser is operable and the vessel for dispensing liquid detergent can be removably mounted on the apparatus.

Nayfa, et al, U.S. Pat. No. 3,761,987 discloses a floor cleaning and polishing machine comprising a housing supported on front and rear drive rollers. A front brush is positioned ahead of the front drive roller and a rear brush is positioned behind the rear drive roller. A supply tank for the working solution includes agitating and aerating means for creating a foam dispensed from a pressurized tank through a flow control gate, and applied to the floor ahead of the front brush. The drive rollers act as squeegees, and vacuum pickup nozzles adjacent each of the drive rollers pick up excess material from the floor surface which is collected in a collection tank on the housing.

The prior art in general, and none of these patents in particular, disclose the present combination carpet vacuum, cleaning, and dyeing apparatus.

SUMMARY OF THE INVENTION

It is therefore an object of the present invention to provide a dry vacuum system having improved lifting properties and mechanical agitation of the carpet.

Another object of this invention is to provide a spray system capable of introducing detergent or clear water for rinsing at high pressure and low volume.

Another object of this invention is to provide a spray system capable of introducing water borne dye pigment at low pressure and high volume.

Another object of this invention is to provide improved liquid penetration without overwetting by providing a rotating brush action to rotate the carpet fibers rather than laying them flat.

Another object of this invention is to provide a wet vacuum system which can easily be used selectively and periodically.

Another object of this invention is to provide an apparatus which will deliver maximum horsepower to the brushes, lift at the vacuum, and pressure at the pump.

Another object of this invention is to provide an apparatus which will safely shut down systems before a dangerous situation arises.

Another other object of this invention is to provide an apparatus which requires low amperage circuits for its operation.

Other objects of the invention will become apparent from time to time throughout the specification and claims as hereinafter related.

The above noted objects and other objects of the invention are accomplished by a combination carpet vacuum, cleaning, and dyeing apparatus having a powerbase unit which houses vacuum and water pressure systems, electrical circuitry, and mixing devices and a remote releasably connected operator controlled powerhead unit which carries a floating vacuum head, electronic circuitry, selectable sprayer manifolds for carpet cleaning or dyeing operations, and a D.C. motor and worm gear transmission to drive a pair of horizontal counter rotating brushes.

DESCRIPTION OF THE PREFERRED EMBODIMENT

Figure 1:
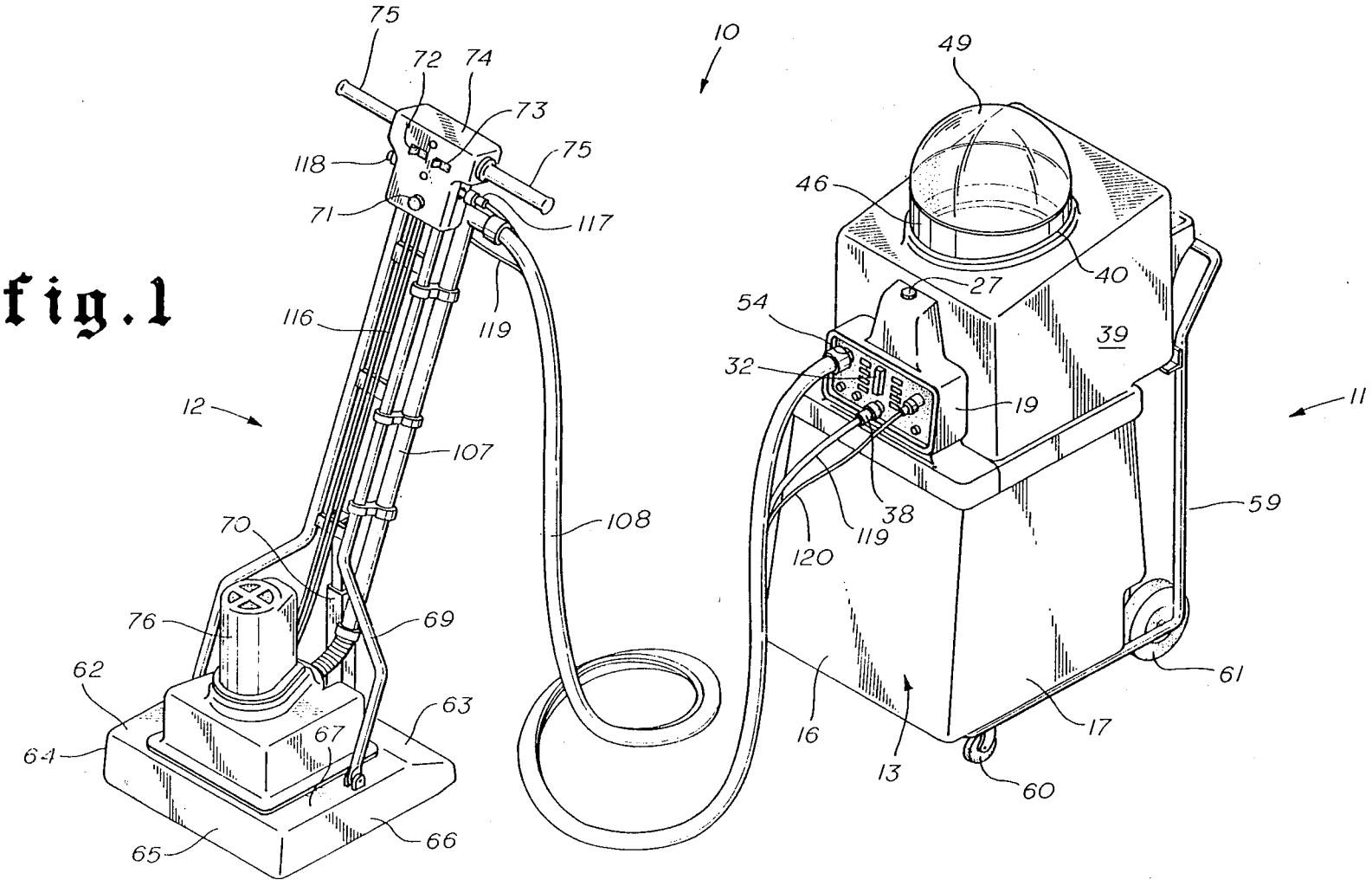
FIG. 1 is an isometric view of the combination carpet vacuum, cleaning, and dyeing apparatus in accordance with the present invention.
Figure 2:
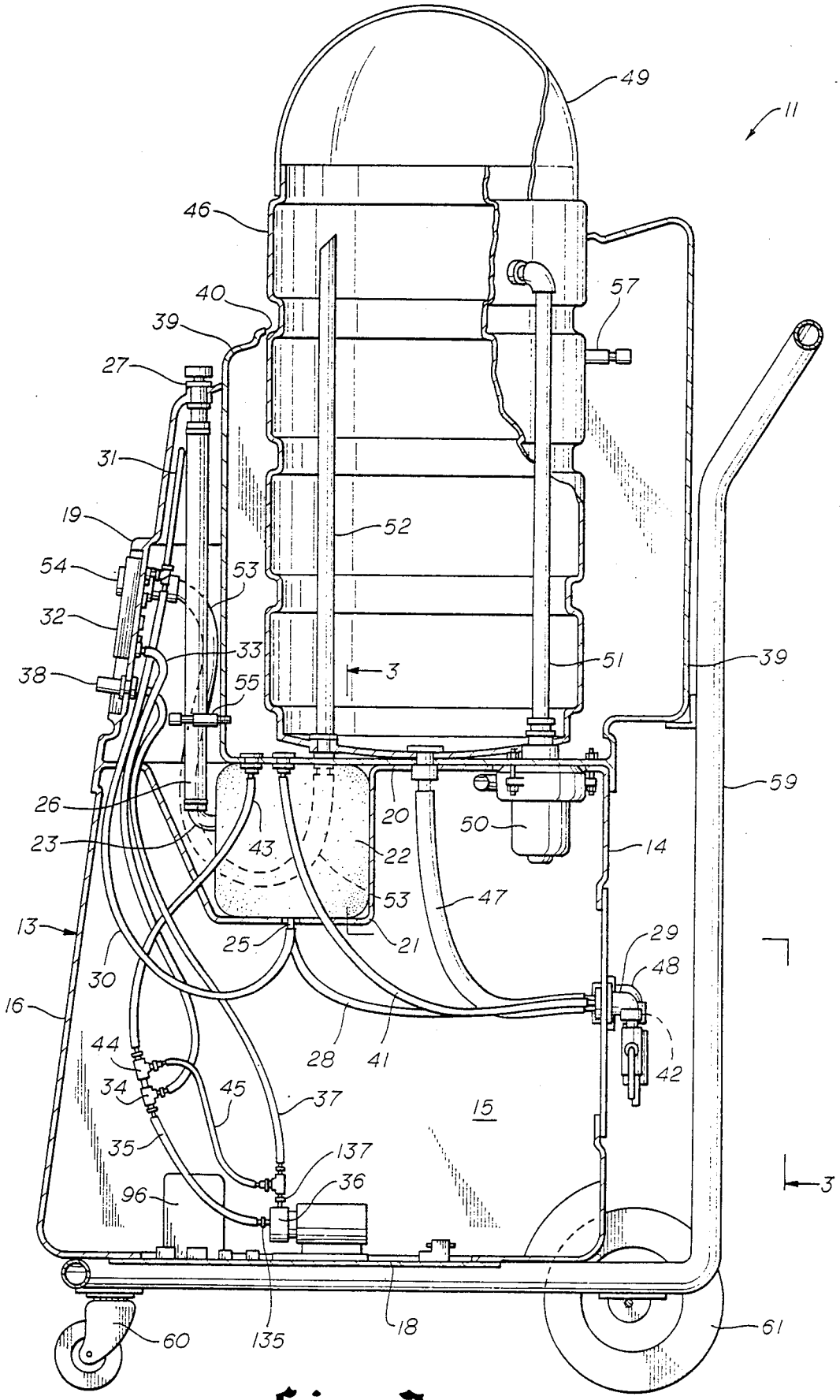
FIG. 2 is a side view in vertical cross section of the powerbase unit of the apparatus.
Figure 6:
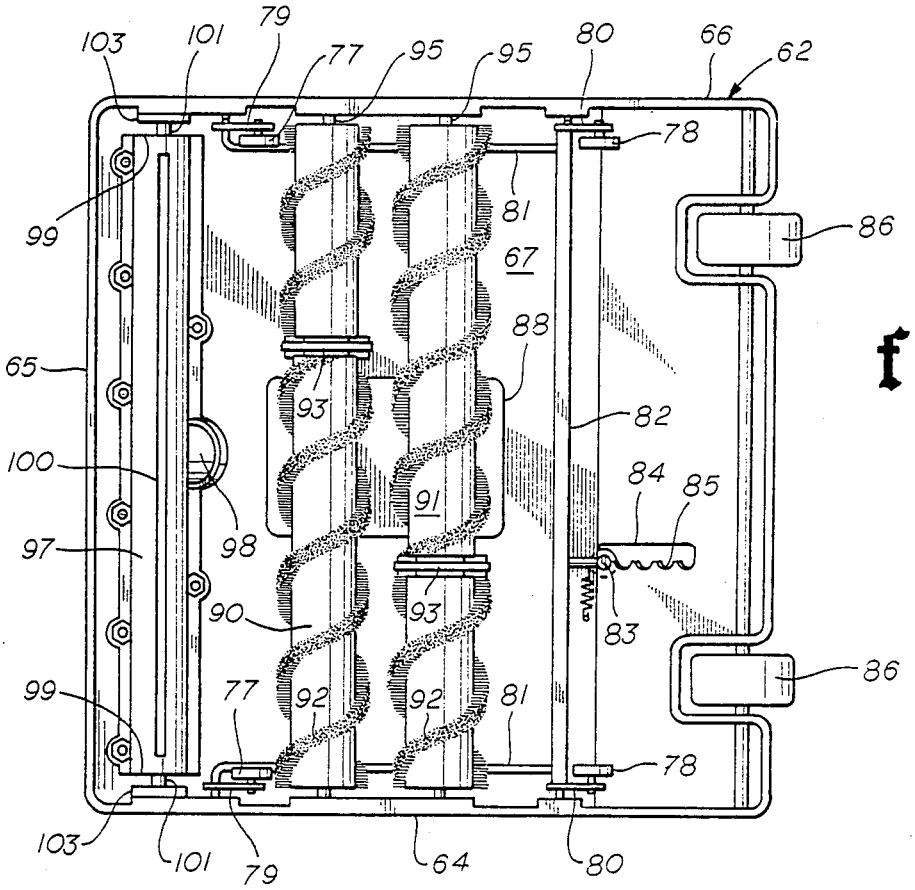
FIG. 6 is a bottom plan view of the housing of the powerhead unit of the apparatus.
Figure 7:
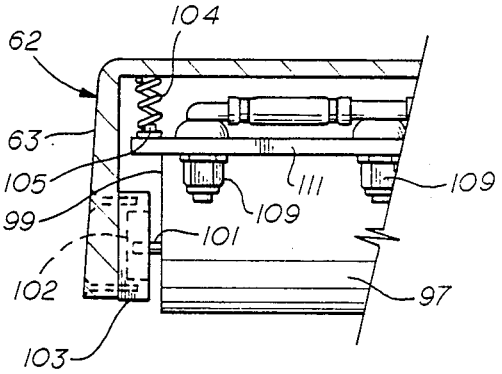
FIG. 7 is a detail view of a portion of the suction head member of the apparatus.
Figure 3:
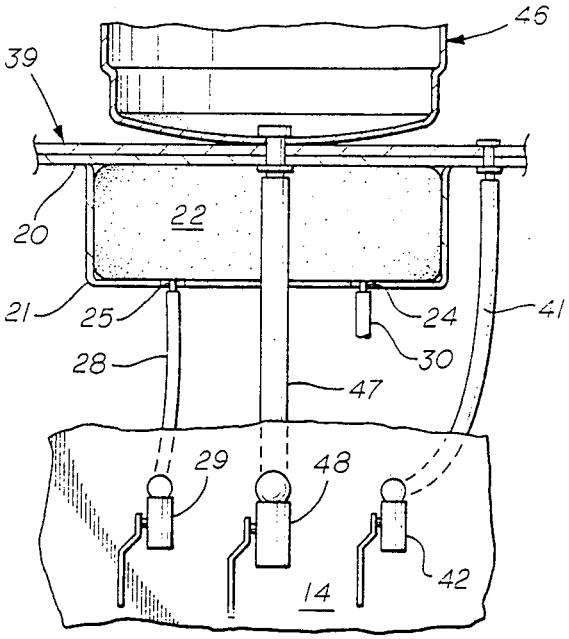
FIG. 3 is a rear detail cross section of the powerbase unit of the apparatus taken along line 3—3 of FIG. 2.
Figure 4:
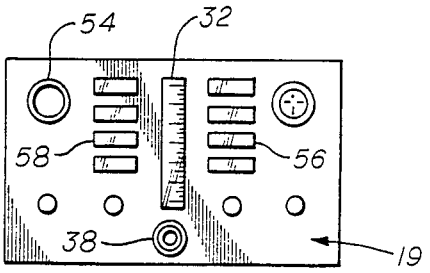
FIG. 4 is a front elevational view of the instrument panel of the powerhead unit of the apparatus.

An understanding of the design of the preferred embodiment of this invention can best be understood by recapitulating the history of the carpet cleaning and dyeing service industry and the need for the design features which combine to make up the invention.

When carpets of synthetic fiber were introduced to the public after World War II, attractive wall-to-wall carpet became affordable as a standard in American homes. The long life of synthetic fiber carpets and the associated problems of piling and fading resulted in the development of the business of professional carpet maintenance.

The carpet maintenance industry at first adopted the tools and machines of the janitorial service business. Then, manufacturers began to provide modified floor buffers and vacuum cleaners and new and better chemicals for use in carpet maintenance.

The so-called steam cleaner was developed as the first of the true carpet cleaners. Although these machines, limited by the available amperage in a typical building (usually 15 amp. or less), could not actually produce steam, there was soon developed truck mounted equipment which could. Truck mounted equipment was powered by gasoline or diesel fuel and could generate substantial heat, pressure and vacuum.

Truck mounted equipment, however, was soon found to have substantial deficiencies. This equipment tended to generate excessive heat which could set the nap or damage fiber. The large truck-mounted units are expensive and raise prices to the consumer considerably. Also, the location of the power plant in the truck has required very long lengths of hose to reach throughout areas being serviced. Consequently, manufacturers have taken a step backward to the old hot water extractors, rotary brush machines, to to a new generation of high-powered portable machines.

For a long time, there has been a need for in-place dyeing of carpets. A number of chemical manufacturers now supply a variety of colorfast dyes specifically designed for carpet. The dyeing equipment, however, remains somewhat primative.

There are a number similarities and differences in the cleaning and dyeing of carpets. Both processes require the introduction of liquid solution to the carpet surface and the extraction of excess water. Carpet cleaning requires high pressure at low volume. In carpet dyeing, hig pressure, which can cause overspray, is a detriment. Even distribution of liquid a required for dyeing.

In both cleaning and dyeing, mechanical action is required but conventional equipment has not been adequate. The scrub wand found on truck mounted equipment and on extractors required operator muscle. Rotary scrubbers or buffers, on the other hand, lay the fibers flat and produce a barrier to the cleaning or dyeing chemicals. The removal of cleaning and dyeing chemicals requires a rinsing or flushing step. The process in similar in both cleaning and dyeing but the location of the spray tip varies.

An analysis of the problems of cleaning and dyeing carpets led to the conclusion that certain features are required in a combination machine to clean and/or dye carpet. These features have been developed and combined in to the present invention.

A dry vacuum system is required with adequate lift and mechanical agitation of the carpet. A spray system is required for introducing detergent for cleaning or clear water for rinsing at high pressure and low volume. The system must deliver liquid in front of a trailing extractor wand during rinsing.

The spray system for introducing water borne dye pigment must operate at low pressure and high volume and must deliver liquid evenly and as close to the walls as the housing construction permits. Brushing action must be rotary in a direction raising the fibers rather than laying them flat to permit liquid penetration without overwetting.

A wet vacuum system is needed which can be used selectively and periodically. Provision must be made for shutting down the equipment and warning the operator on occurrence of maximum horsepower delivered to the brushes, maximum lift at the vacuum, and maximum pressure at the pump.

All of these features must be present in an apparatus which is light and portable and will operate on no more than two 15 amp. circuits.

Referring to the drawings by numerals of reference and particularly to FIGS. 1–4, there is shown a preferred embodiment of a combination carpet vacuum, cleaning, and dyeing apparatus 10 comprising a powerbase unit 11 and a powerhead unit 12.

The powerbase unit 11 houses the vacuum and water pressure systems, the electrical circuitry, and mixing devices to supply the powerhead unit 12 with various solutions of water and other chemicals. The powerhead unit 12 carries the motor and transmission to drive the brushes, sprayer manifolds for carpet cleaning and dyeing, a vacuum head, counterrotating brushes, electronic circuitry, and operator controls to provide the operator with manifold selection, remote vacuum control, and motor control.

The powerbase unit 11 comprises a generally box shaped lower component housing 13 having rear, left side, front, and right side walls, 14, 15, 16, and 17, respectively. An electronics mounting plate 18 forms the bottom of the housing 13 and carries some of the electronic components of the circuitry. The housing 13 is mounted on a tubular frame cart 59 having a front pair of casters 60 and a rear pair of wheels 61. A molded extension at the top of the front wall 16 is contoured to form an instrument panel 19 thereon. The top 20 of housing 13 is enclosed and provided with a rectangular recessed portion 21 to receive a generally rectangular detergent tank 22.

Detergent tank 22 has an upwardly extended elbow opening 23 at its top and two small depending tubes 24 and 25 at its bottom which protrude from the recessed portion 21. A flexible hose 26 connects the elbow 23 to a filler neck fitting 27 at the top of the instrument panel 19. A length of tubing 28 connects one depending tube 25 to a $\frac{3}{4}''$ ball valve 29 attached to the rear wall 14 of the housing 13 for dumping the system. A second length of tubing 30 connects the other depending tube 24 to a vacuum break tube 31 connected at instrument panel 19 to a flow meter 32 calibrated in ounces per gallon.

Vacuum break tube 31 extends above the highest liquid level to prevent unwanted water and chemical from entering the system. Another length of tubing 33 runs from the flow meter 32 to a tee fitting 34 which is in turn connected by another length of tubing 35 to the inlet side 135 of a pump 36 supported on plate 18. Another length of tubing 37 connects the discharge side 137 of the pump 36 to a quick disconnect coupling 38 in the instrument panel 19.

A generally rectangular clear water tank 39, having a circular opening 40 in its top and a recessed bottom, slip fits onto the top 20 of the housing 13 at the rear of instrument panel 19. Clear water tank 39 is secured to the top 20 of the housing 13 by conventional bulkhead fittings. A length of tubing 41 connects water tank 39 to a $\frac{3}{4}''$ ball valve 42 attached to the rear wall 14 of the housing 13 for dumping the system.

Another length of tubing 43 runs from a second bulkhead fitting which has an internal strainer (not shown) at the bottom of the clear water tank 39 to a second tee fitting 44 connected in line with the first tee fitting 34. A small $\frac{1}{8}''$ bypass tube 45 extends from the stem of tee fitting 44 to the discharge side of pump 36.

A closed bottom hollow cylindrical recovery tank 46 extends through the circular opening 40 of the water tank 39 and rests on the bottom of the clear water tank 39. Recovery tank 46 is secured to housing 13 by bulkhead fittings. A length of 1" tubing 47 connects the recovery tank 46 to a 1" ball valve 48 attached to the rear wall 14 of the housing 13 for dumping the system. A clear acrylic dome 49 sealably fits on the top of the recovery tank 46 to allow observation of the extraction process.

A vacuum motor 50 attached to the underside of the top 20 of the housing 13 and has suction tube 51 extending upwardly outside the recovery tank 46 and opening into tank 46 near its top. An air inlet tube 52 is attached to the bottom of the recovery tank 46 by bulkhead fittings and extends upwardly therein. A vacuum hose 53 connects inlet tube 52 to a hose fitting 54 in the instrument panel 19.

A liquid level sensor 55 mounted on the clear water tank 39 will shut down the pump 36 and light a warning light 56 (FIG. 4) on the instrument panel 19 to protect the unit from running dry and alert the operator that the water supply is gone. Another liquid level sensor 57 mounted on recovery tank 46 will shut down the vacuum system and warn the operator with a light 58 of a full recovery tank to prevent liquid from being drawn into the vacuum motor 50.

Referring now to FIGS. 1, 5, 6, and 7, powerhead unit 12 comprises a generally rectangular housing 62 having rear, left side, front, and right side walls, 63, 64, 65, and 66 respectively. The top surface 67 of the housing 62 has an opening 68. A bifurcated tubular handle 69 is pivotally connected to the housing 62 and a telescoping and lockable handle lock tube 70 is connected therebetween to provide handle height adjustment for operator convenience. A nozzle selection switch 71, on-off brush motor switch 72, and low voltage vacuum motor switch 73 are installed in a switch cover 74 near the handlebars 75. Vacuum motor switch 73 trips a relay in the powerbase unit 11 to actuate vacuum motor 50. Motor cover 76 attaches to the top 67 of housing 62 to cover the power unit for the brush system.

A pair of front wheels 77 and rear wheels 78 are rotatably attached to a pair of front wheel cam brackets 79 and a pair of rear wheel cam brackets 80 which are pivotally attached to the left and right side walls 64 and 66. A pair of wheel adjustment rods 81 pivotally connect each front and rear cam bracket 79 and 80. A transverse cross bar 82 connects the two rear cam brackets 80 and a spring biased wheel adjustment lever 83 is pivotally attached thereto.

Lever 83 extends through vertical slot 84 in the rear wall 63 which has a series of vertically spaced arcuate openings 85 along one side. The lever and slot mechanism provides height adjustment of the wheels 77 and 78 relative to the housing 62. Vertical height adjustment is necessary to accomodate different heights of carpet pile. A larger pair of wheels 86 are rotatably mounted on an axle extending between the left and right side walls 64 and 66 near the rear of the housing 62 for transporting the powerhead unit 12 when not in use.

The power unit for the brush system comprises a vertically disposed 24 volt D.C. motor 87 (FIG. 5) and a small transmission 88 attached to the top surface 67 of the housing 62. Transmission 88 contains a vertical worm gear which drives two lateral counterrotating worm gears each having sheaves 89 at their extended end.

The brushes for the powerhead unit comprise elongated stainless steel front and rear brush tubes 90 and 91 respectively, having circumferentially disposed spirally wound outwardly extending bristles 92. A sheave 93 smaller in diameter than the extended ends of the bristles 92 is disposed on each brush tube in alignment with the sheaves 89 on the transmission 88 and a timing belt 94 connected therebetween drives the brushes in counter rotation. The brush tubes 90 and 91 are journaled on axles 95 extending between the left and right side walls 64 and 66. The counterrotational brushing action carries each fiber in complete rotation (left to right and front to rear), to provide maximum fiber grooming, dirt removal, and penetration of liquids without overwetting.

Low voltage D.C. is supplied by a dual wound enclosed transformer 96 (FIG. 2) and rectified by integrated full wave bridge circuits. The low voltage 24 volt D.C. motor is safer than the typical 115 volts delivered to a conventional machine and it effectively uses only 3 amps on the primary side of the transformer but delivers 20 amps and the resulting high R.P.M. associated with D.C. motors to the transmission. The R.P.M.s are reduced through the transmission yielding the same torque that would require 13 amps in a conventional A.C. motor. Individually fused circuits provide additional safety.

A floating suction member or vacuum head 97 is located neat the front wall 65 of the housing 62. The vacuum head 97 comprises a generally hollow T-shaped tubular member having an angularly and upwardly extending hollow stem portion 98 and its two opposed extended ends 99 are closed. A slot 100 extends longitudinally between the closed ends 99 on the underside of the vacuum head 97. Pins 101 extend outwardly from the closed ends 99 and slide vertically in slots 102 provided in brackets 103 attached to left and right side wall 64 and 66 of the housing 62. Compression springs 104 mounted on vertically extending pins 105 atop each extended end of the vacuum head 97 are biased between the top of the housing 67 and the head 97 to urge it downward onto the carpet surface.

A flexible hose 106 connects the hollow stem 98 of the vacuum head 97 to the lower end of a clear plastic vacuum tube 107 attached to the handle 69. A longer flexible hose 108 connects the upper end of the clear vacuum tube 107 to the hose fitting 54 on the instrument panel 19 of the powerbase unit 11. Clear plastic vacuum tube 107 allows the operator to observe the extraction process.

The floating vacuum head 97 carries two sets of spray nozzles 109 and 110 attached to a flat horizontal mounting flange 111 at the top thereof. Flange 111 extends forward and rearward relative to the slot 100 and its height is such that the tip of the nozzles is preferably 1.8" above the slotted bottom of the vacuum head 97. The front set of nozzles 109 are used for the dyeing operation, and the rear set of nozzles 110 are used in the cleaning operation. Forward displacement of the front nozzles 109 is adequate to provide application of solution as close to room walls as possible, and rearward displacement of the rear nozzles 111 is based upon the normal cleaning action of a rearward motion which applies solution just prior to extraction by the vacuum head 97.

Figure 8:
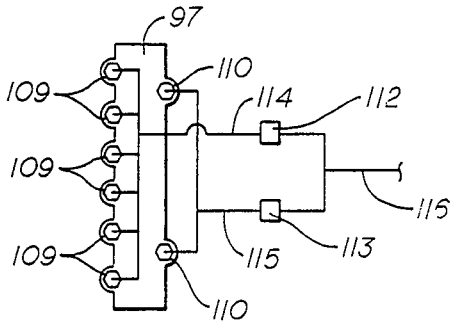
FIG. 8 is a schematic illustration of the nozzle selection feature of the apparatus.
Figure 5:
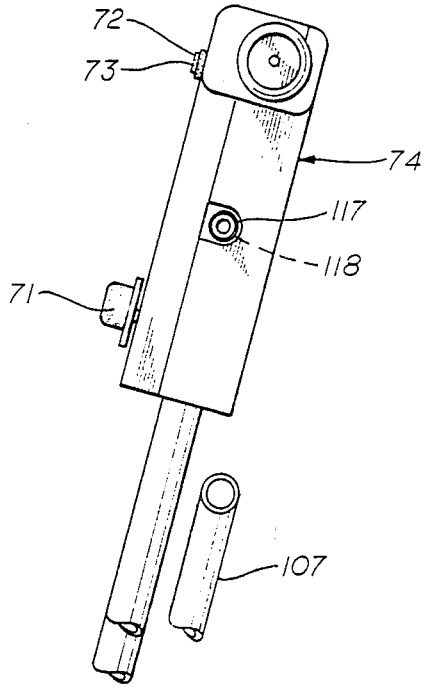
FIG. 5 is a side view in vertical cross section of the powerhead unit of the apparatus.
Figure 5:
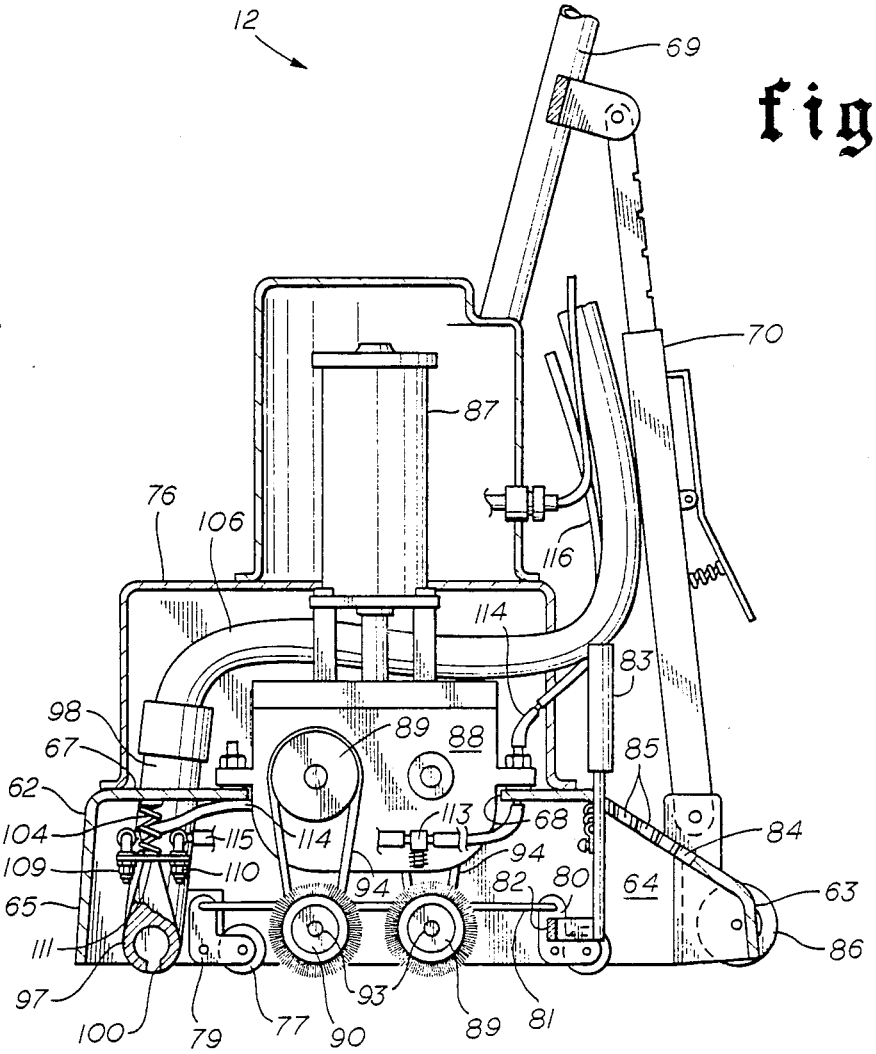

Nozzle selection is accomplished with the switch 71 which operates either of two relays or electromagnetic valves 112 and 113 (FIG. 8). One valve 112 controls liquid supply to the front nozzles 109 through tubing 114, and the other valve 113 controls liquid flow to the rear nozzles 110 through tubing 115. The two sections of tubing 114 and 115 are joined by a tee fitting and another section of tubing 116 extends therefrom upwardly along the handle 69 and is joined by another tee fitting to two opposed quick disconnect couplings 117 and 118 extending outwardly from switch cover 75. A small relatively long pressure hose 119 connects one quick disconnect coupling to the quick disconnect coupling 38 at the instrument panel 19 to provide the vacuum head 97 with various solutions of water and other chemicals.

Electrical communication is established between the powerhead unit 12 and the powerbase unit 11 by means of an electrical cable 120 releasably plugged into switch cover 74 and the instrument panel 19 on the powerbase 11. The vacuum system in the apparatus 10 is created by causing a partial vacuum within the cylindrical recovery tank 46 of the powerbase unit 11. Air is then introduced to the recovery tank 46 via the hose 108 connected to the floating vacuum head 97 through the connection on the powerhead unit 12. Spring force maintains a seal between the slot 100 in the vacuum head 97 and the carpet surface.

OPERATION

The powerbase unit 11 of the apparatus is plugged into a 110 volt A.C. outlet and the switch turned on to start the vacuum motor 50 causing a partial vacuum within the recovery tank 46. Air is drawn into slot 100 at the bottom of the floating vacuum head 97 in the powerhead unit 12 and travels through the clear vacuum tube 108 and connecting hoses to enter the recovery tank 46 on the powerbase unit. The degree of extraction may be observed through the clear vacuum tube and the clear dome 49 on the tank and the carpet may be dry vacuumed in the normal manner.

To clean the carpet, the clear water tank 39 and the detergent tank 22 are filled. The vacuum motor 50 is once again turned on and the pump motor switch is turned to pressurize the system. When the powerhead is in position, the brush motor 87 is turned on and the nozzle selection switch 71 is turned to select the rear nozzles 110. The normal cleaning action is a rearward motion and the application of the detergent solution just prior to extraction by the vacuum head.

The dyeing operation follows the same procedure as the cleaning operation except that the dye solution is put into the solution tank and the front nozzles 109 are put into operation. The counterrotational brushing action carries each fiber in complete rotation (left to right and front to rear), to provide maximum fiber grooming, dirt removal, and penetration of liquids without overwetting.

While this invention has been described fully and completely with special emphasis upon a preferred embodiment, it should be understood that within the scope of the appended claims the invention may be practiced otherwise than as specifically described herein.

I claim:

1. An apparatus for vacuuming, cleaning, and dyeing carpet comprising means for mechanically agitating the fibers of a carpet with a rotary and lifting movement, vacuum-applying means for applying dry air suction to said carpet adjacent to the zone of agitation by said mechanical agitating means, means for supplying detergent for cleaning and water for rinsing to a carpet at high pressure and low volume, means for supplying a carpet dye or pigment in water evenly to a carpet at low pressure and high volume, and means including said vacuum applying means for applying wet suction to a carpet wet with a carpet treating material, selectively at preselected times.

2. An apparatus according to claim 1 in which said detergent and rinse water supply means is positioned to deliver liquid in front of said wet suction applying means to apply liquid and remove liquid in sequence from the carpet being treated.

3. An apparatus according to claim 1 including direct current motor means for operating said vacuum pump and said first and second named supply means.

4. An apparatus according to claim 1 including means responsive to the operation of selected ones of the carpet treating means and operable to inactivate said apparatus in response to the occurrence of an unsafe condition.

5. An apparatus according to claim 1 including a movable powerbase for movement over a carpet surface, a powerhead operatively connected to said powerbase comprising a housing with front and rear supporting means for movement over a carpet surface, a handle on said housing for moving the same, said detergent supply means and said dye or pigment supply means comprising a plurality of solution supply means, means for withdrawing and pressurizing a liquid solution from at least one of said solution supply means, means connecting said powerhead to said powerbase, and said solution supply means, said vacuum applying means comprising suction means extending transversely across and mounted in said housing to be moved adjacent to a carpet surface, front and rear solution dispensing means operatively connected to said solution supply means for supplying said detergent and rinse water and for supplying said carpet dye or pigment, said carpet fiber agitating means comprising both brush means extending transversely across said housing behind said suction means and supported adjacent to the carpet surface, and means to drive said brush means.

6. An apparatus according to claim 5 in which said detergent and rinse water supply means is positioned to deliver liquid in front of said wet suction applying means to apply liquid and remove liquid in sequence from the carpet being treated.

7. An apparatus according to claim 5 including means responsive to the operation of selected ones of the carpet treating means and operable to inactivate said apparatus in response to the occurrence of an unsafe condition.

8. An apparatus for vacuuming, cleaning, and dyeing carpet comprising a movable powerbase for movement over a carpet surface, an enclosure, means for circulating air through said enclosure, a first supply means for detergent and for rinse water for carpet cleaning, a second supply means for supplying dye or pigment in water for carpet dyeing, means for supplying detergent for cleaning and water for rinsing from said first supply means to a carpet at high pressure and low volume, means for supplying a carpet dye or pigment in water from said second supply means evenly to a carpet at low pressure and high volume, a direct current supply, releasable connecting means on said powerbase communicating with said enclosure, said first and second supply means, and said direct current supply, and a powerhead comprising;

a housing with top and side walls, and having front and rear supporting means for movement over a carpet surface, a handle pivotally connected to said housing, releasable connecting means on said handle operatively connected to said first-named releasable connecting means for connecting said powerhead to said enclosure, said first and second supply means, and said direct current supply of said powerbase, suction means in said powerhead having a bottom air inlet and a top air outlet extending transversely across and mounted in said housing near the front end thereof to be moved adjacent to a carpet surface, means connecting said air suction means with said releasable connecting means on said powerbase, front and rear liquid dispensing means connected to said first and second supply means, said suction means being operable to apply suction under wet conditions to a carpet wet with a carpet treating material, selectively at different times, brush means extending transversely across said housing adjacent to and behind said suction means and supported in a plane parallel to the carpet surface, and means to drive said brush means.

9. An apparatus according to claim 8 further comprising means on said powerbase for indicating liquid levels in said enclosure and said supply means, respectively, and operable to deactivate said air circulating means and said liquid pressurizing means upon the liquid level reaching a predetermined level.

10. An apparatus according to claim 9 in which said indicating means comprises a liquid level sensing switch on said enclosure, a relay switch operatively connected to said sensing switch, a liquid level sensor on said supply means, and a relay switch operatively connected to said sensor.

11. An apparatus according to claim 8 further comprising means on said powerbase communicating with said enclosure and said supply means for dumping the contents thereof.

12. An apparatus according to claim 11 in which said dumping means comprises at least one ball valve.

13. An apparatus according to claim 8 further comprising means cooperable with said supporting means for selective vertical adjustment of said housing relative to a carpet surface.

14. An apparatus according to claim 8 in which said front and rear liquid dispensing means further includes control means for selectively dispensing liquid uniformly across the carpet surface.

15. An apparatus according to claim 8 in which said means for circulating air through said enclosure comprises a pump, means connecting said pump with said enclosure, and and an air inlet communicating with said enclosure.

16. An apparatus according to claim 8 in which said means for supplying detergent, rinse water, and dye or pigment from said first and second supply means comprises a pump, a vacuum break tube disposed between said supply means and said pump, and a flow metering device disposed between said vacuum break tube and said pump.

17. An apparatus according to claim 8 in which said enclosure member in said powerbase has a clear plastic dome for observation of the extraction process.

18. An apparatus according to claim 8 in which said releasable connecting means on said powerbase communicating with said enclosure comprises a hose fitting, said connecting means communicating with said solution supply means comprises a quick disconnect coupling, and said connecting means communicating with said direct current supply means comprises an electrical plug.

19. An apparatus according to claim 8 in which said suction means mounted in said housing comprises a hollow inverted generally T-shaped tubular member having an elongated bottom portion with two opposed closed ends and an open ended hollow stem portion extending angularly upward therefrom, a longitudinally extending slot in the underside of said bottom portion terminating before said opposed closed ends for the induction of air, pins extended laterally outwardly from each of said closed ends slidably received in slots provided in brackets attached said left and right side walls of said housing for pivotal and rotary movement, and compression springs biased against the underside of said powerhead top wall and mounted on vertically extending pins on each of said closed ends to urge the same downwardly onto a carpet surface.

20. An apparatus according to claim 19 in which said air conduit means on said powerhead member communicating said air suction means with said releasable connecting means on said powerbase comprises a first flexible hose having one end attached to said air outlet portion of said suction member, a clear plastic tubular member secured to said handle having its lower end attached to the other end of said flexible hose, and a second flexible hose having one end attached to the upper end of said clear plastic member and its other end releasably attached to said releasable connecting means on said powerbase member.

21. An apparatus according to claim 8 in which said front and rear liquid dispensing means comprises a front set of spray nozzles carried on said suction member disposed forward thereof, a rear set of spray nozzles carried on said suction member disposed rearwardly thereof, a first tee fitting, a first tubing having one end attached to said front nozzles and its other end attached to one end of said first tee fitting, a valve interposed between said front nozzles and said first tee fitting to control liquid flow therethrough, a second tubing having one end attached to said rear nozzles and its other end attached to another end of said first tee fitting, a valve interposed between said rear nozzles and said first tee fitting to control liquid flow therethrough, a second tee fitting, a third tubing having its lower end attached to the remaining end of said first tee fitting and its upper end attached to one end of said second tee fitting, two opposed releasable connecting means extending outwardly from said second tee fitting, a fourth flexible tubing having connecting means at each end for attaching said connecting means on said powerhead member to said connecting means on said powerbase member to supply said dispensing means with selected liquids from said first and second supply means.

22. An apparatus according to claim 8 in which said brush drive means comprises a D.C. drive motor, a transmission having a worm gear and two counterrotating laterally extending worm gears cooperable therewith, and sheaves on ends of said worm gears.

23. An apparatus according to claim 8 in which said brush means comprises elongated tubular stainless steel front and rear brush tubes journaled on axles extending between said left and right side walls, spirally wound outwardly extending bristles circumferentially wound thereon, and means cooperable with said brush drive means to transmit rotary motion therefrom.

24. An apparatus according to claim 23 in which said rotary motion transmitting means comprises a sheave smaller in diameter than the extended ends of said bristles disposed on each said brush tube, and one or more timing belts connecting said sheaves to said brush drive means to drive said brushes in counterrotational movement.

25. An apparatus according to claim 8 in which said front and rear supporting means on said housing for transporting said powerhead over the carpet surface comprises front wheel cam brackets on said housing, a pair of front wheels rotatably attached to said front wheel cam brackets, rear wheel cam brackets pivotally attached to the walls of said housing, a pair of rear wheels rotatably attached to said rear wheel cam brackets, wheel adjustment rods pivotally connecting each front and rear cam bracket, and a cross bar rigidly connecting said two rear cam brackets.

26. An apparatus according to claim 8 further comprising means on said housing cooperable with said supporting means for selective vertical adjustment of said housing relative to said carpet surface.

27. An apparatus according to claim 26 in which said vertical adjustment means comprises a spring biased wheel adjustment lever having one end pivotally attached to said transverse cross bar and the other end extending through a vertical slot in the rear wall of said housing, and said slot having a series of vertically spaced arcuate openings along one side.

28. An apparatus according to claim 8 in which said releasable connecting means on said handle for connecting said powerhead with said enclosure comprises a hose fitting, said means for connecting said first and second supply means comprises a quick disconnect coupling, and said connecting means for connecting said direct current supply of said powerbase comprises an electrical plug.

29. An apparatus for vacuuming, cleaning, and dyeing carpet comprising in combination;

a powerbase member having means for supporting and transporting said powerbase over a carpet surface, a sealable enclosure member in said powerbase, a plurality of solution supply means, including dye supply means, in said powerbase, means in said powerbase for circulating air through said enclosure comprising a pump unit, air extracting means communicating said pump unit with said enclosure, air inlet means communicating with said enclosure, pump means in said powerbase for withdrawing and pressurizing a liquid solution from one or more of said solution supply means, a vacuum break tube between said supply means and said pump means, a flow metering device disposed between said vacuum break tube and said pump means, a transformer in said powerbase for transforming a source of alternating current to a direct current supply, a first power line for connecting said transformer to a source of a.c. power, means on said powerbase for indicating liquid level in said enclosure and said solution supply means whereby said air extracting means and said liquid extracting means will be deactivated upon reaching a predetermined level, said means comprising a liquid level sensing switch on said enclosure and a relay switch cooperable therewith interposed between said air extracting means and its electrical current source, and a liquid level sensor on said solution supply means and a relay switch cooperable therewith switch interposed between said liquid extracting means and its electrical current source.

means on said powerbase communicating with said enclosure and said solution supply means for dumping the contents thereof, releasable connecting means on said powerbase communicating with said enclosure, said solution supply means, and said direct current supply, a powerhead member comprising a housing having top and side walls, front and rear supporting means on said housing for transporting the same over a carpet surface, means on said housing cooperable with said supporting means for selective vertical adjustment of said housing relative to the carpet surface, a handle pivotally connected to said housing and height adjusting and locking means therefor, releasable connecting means on said handle operatively connected to said first-named releasable connecting means for connecting said powerhead to said enclosure, said solution supply means, and said direct current supply of said powerbase, suction means having a bottom air inlet and a top air outlet extending transversely across and pivotally mounted in said housing near the front wall thereof to contact and ride upon the carpet surface comprising;

a hollow inverted generally T-shaped tubular member having an elongated bottom portion with two opposed closed ends and an open ended hollow stem portion extending angularly upward therefrom, a longitudinally extending slot disposed on the underside of said bottom portion terminating before said opposed closed ends for the induction of air, slotted brackets attached to side walls of said housing, pins extending outward from each of said closed ends slidably received in said bracket slots for pivotal and rotary movement, compression springs biased against the underside of said powerhead top wall and mounted on vertically extending pins disposed on each of said closed ends to urge the same downward onto the carpet surface, air conduit means on said powerhead comprising:

a clear plastic tubular member secured to said handle, a section of flexible hose having one end attached to said open stem portion of said suction member and the other end attached to the lower end of said clear plastic tubular member, said second-named releasable connecting means including a flexible hose connecting the upper end of said clear plastic member to said releasable connecting means on said powerbase member, a front and rear solution dispensing means in said powerhead member communicating with said liquid supply means in said powerbase member including control means for selectively dispensing solution uniformly across the carpet surface comprising;

a front set of spray nozzles carried on said suction member and disposed relative to said slot with the tips of said nozzles at predetermined height thereabove, a rear set of spray nozzles carried on said suction member and disposed rearwardly of said slot whereby solution may be applied to the carpet surface in a rearward motion just prior to extraction by said suction member, a first tee fitting, a first tubing having one end attached to said front nozzles and the other end attached to one end of said first tee fitting and a valve means interposed therebetween to control the liquid flow therethrough, a second tubing having one end attached to said rear nozzles and the other end attached to another end of said first tee fitting and valve means interposed therebetween to control the liquid flow therethrough, a second tee fitting, a third tubing having its lower end attached to the remaining end of said first tee fitting and its upper end attached to one end of said second tee fitting and two opposed releasable connecting means extending outwardly therefrom, a fourth tubing having connecting means at each end for attaching said connecting means on said powerhead member to said connecting means on said powerbase member to supply said dispensing means with various liquid solutions, brush drive means supported on said housing comprising a vertically disposed 24 volt D. C. drive motor, a second power line connecting said transformer to said motor, a transmission including a worm gear and two counterrotating laterally extending worm gears driven thereby, sheaves attached to the extended ends of said worm gears brush means extending transversely across said housing behind said suction member and supported in a plane parallel to the carpet surface comprising;

elongated tubular stainless steel front and rear brush tubes journalled on axles extending between the housing side walls and having circumferentially disposed spirally wound outwardly extending bristles thereon, a sheave smaller in diameter than the extended ends of said bristles disposed on each said brush tube in alignment with said sheaves on said worm gears, and a timing belt connected therebetween to drive said brushes in counterrotational movement.

* * * * *